United States Patent [19]

King et al.

[11] Patent Number: 4,567,668

[45] Date of Patent: Feb. 4, 1986

[54] ARCHERY BOW SIGHT

[75] Inventors: Freddie L. King, Broken Arrow; August E. Siekman, Tulsa, both of Okla.

[73] Assignee: Accra 300, Broken Arrow, Okla.

[21] Appl. No.: 695,058

[22] Filed: Jan. 25, 1985

[51] Int. Cl.[4] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 2,351,103 | 6/1944 | Brown | 33/46 |
| 3,058,221 | 11/1962 | McNeel | 33/46 |
| 3,355,809 | 12/1967 | Guyton | 33/46 |
| 3,368,282 | 2/1968 | Gibson et al. | 33/265 |
| 3,667,444 | 6/1972 | Depatie et al. | 124/24 |
| 3,787,984 | 1/1974 | Bear et al. | 33/265 |
| 3,854,217 | 12/1974 | Killian | 33/265 |
| 3,871,105 | 3/1975 | Brougham | 33/265 |
| 4,020,560 | 5/1977 | Heck | 33/265 |
| 4,136,461 | 1/1979 | Gasser | 33/265 |
| 4,142,297 | 3/1979 | Altier | 33/265 |
| 4,142,298 | 3/1979 | Killian | 33/265 |
| 4,237,615 | 12/1980 | Bracknell | 33/265 |
| 4,368,581 | 1/1983 | Tullos | 33/265 |

*Primary Examiner*—Richard R. Stearns

*Attorney, Agent, or Firm*—W. Scott Carson

[57] ABSTRACT

An archery bow signt including an extension bar, sight bar, carriage, sight-supporting block, and bubble level wherein the improvement is directed to an arrangement for pivotally adjusting one of the sight members relative to another. In the preferred embodiment, the member to be adjusted is mounted to an underlying, second member by two bolts or screws which ordinarily lock the two members together. In operation to make an adjustment, the locking screws are first loosened wherein one of the screws is then used to define the pivotal axis about which the adjustment is made. To do this, the shaft of the second screw is received in an elongated slot in the member to be adjusted and as this member is pivoted, the elongated slot therein accommodates the relative movement of the second screw. The fine adjustment of the two members is then accomplished by manipulation of only a single set screw which contacts the shaft of the second screw and works against a coil spring. In operation, the set screw can be moved in one direction against the shaft of the locking screw to pivotally move the first member relative to the second under the force of the advancing set screws; and, conversely, the set screw can be moved in the opposite direction to pivot the first member relative to the second under the force of the coil spring.

18 Claims, 7 Drawing Figures

ARCHERY BOW SIGHT

FIELD OF INVENTION

This invention relates to the field of archery bow sights.

BACKGROUND OF THE INVENTION AND PRIOR ART

Archery bow sights have become very sophisticated as evidenced by the sights of U.S. Pat. Nos. 2,351,103 to Brown, 3,058,221 to McNeel, 3,355,809 to Guyton, 3,667,444 to Depatie, 3,854,217 to Killian, 3,871,105 to Brougham, 4,020,560 to Heck, 4,136,461 to Berneck, 4,142,297 to Altier, 4,142,282 to Killian, 4,237,615 to Bracknell, and 4,368,581 to Tullos. Common among these sights is the ability to adjust the various elements of the sight relative to one another and the bow for improved accuracy. As illustrated by U.S. Pat. No. 3,854,217 to Killian, such adjustments are typically both orthogonal (e.g., vertical movement of Killian's sight bar 42 relative to his horizontal, extension bar 20) and pivotal (e.g., pivotal movement of Killian's sight-supporting block 50 relative to his underlying carriage 48). Further, such adjustments are both gross and fine in degree (e.g., gross movement of Killian's sight bar on his extension bar using his latch arrangement 64 versus the fine movement of these two members that can be accomplished using his screw 68).

The present invention involves improvements in the manner of making fine, pivotal adjustments of one sight member relative to another. For example, in the disclosed manner of U.S. Pat. No. 3,854,217 to Killian, the pivotal adjustment of his sight-supporting block 50 relative to his underlying carriage 48 must not only be done by manually moving 50 relative to 48 but the two members must also be manually held in place while his locking screws 56 are retightened. This is obviously a fairly cumbersome manner in which to attempt to precisely level an element such as his bubble sight 112. Further, if the desired leveling is not initially achieved, Killian's entire process of loosening the locking screws 56, manually pivoting his member 50, holding the member 50 in place, and retightening the screws 56 must be repeated. In contrast, the embodiments of the present invention precisely move one member relative to another by manipulation of only a single set screw. Further, this arrangement will hold the members in the desired relative positioning until the locking screws can be retightened. Additionally, if the desired positioning is not initially achieved, the embodiments of the present invention will hold the members in the previous positioning while the locking screws are loosened wherein the previous positioning can then be used as a reference point to make any further adjustments.

SUMMARY OF THE INVENTION

This invention involves an archery bow sight. The sight includes an extension bar, sight bar, carriage, sight-supporting block, and bubble level and the improvement is directed to an arrangement for pivotally adjusting of the sight members relative to another. In this manner, for example, the sight bar can be precisely positioned on the extension bar or the sight-supporting block precisely positioned on the carriage for improved accuracy.

In the preferred embodiment, the member to be adjusted is mounted to an underlying, second member by two bolts or screws. The two screws ordinarily lock the two members together to prevent relative movement. However, to make an adjustment, the locking screws are first loosened wherein one of the screws is then used to define the pivotal axis about which the adjustment is made. To do this, the shaft of the second screw is received in an elongated slot in the member to be adjusted and as this member is pivoted, the elongated slot therein accommodates the relative movement of the second screw. In this preferred embodiment, the fine adjustment of the two members is then accomplished by manipulation of only a single set screw. The set screw contacts the shaft portion of the second screw and works against a coil spring. The set screw and coil spring are mounted in opposing bores in the member to be adjusted and extend into the elongated slot of this member to contact the screw shaft on opposite sides thereof. In operation, the set screw can then be moved in one direction against the shaft of the locking screw to pivotally move the first member relative to the second under the force of the advancing set screw; and, conversely, the set screw can be moved in the opposite direction to pivot the first member relative to the second member under the force of the coil spring. During both adjustments, the set screw and coil spring maintain contact with the shaft portion and will hold the two members in the desired relative positions until the locking screws can again be retightened. Additionally, as disclosed in a second embodiment, the adjustment arrangement of the set screw and coil spring can alternately be positioned in the fixed member (e.g., extension bar) relative to which the other member (e.g., sight bar) is pivoted.

DETAILED DESCRIPTION OF THE PREFERRED EMBODIMENTS

Figure 1:
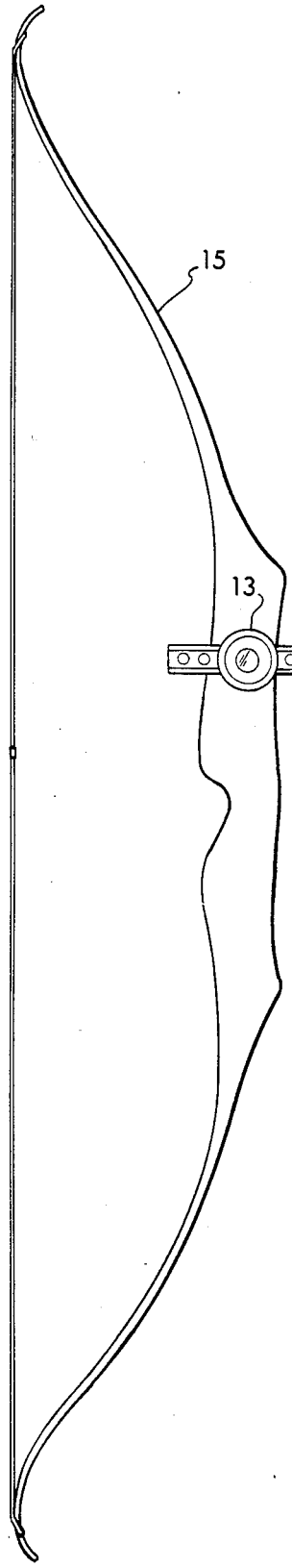
FIG. 1 is a side view of the sight of the present invention mounted on an archery bow.
Figure 2:
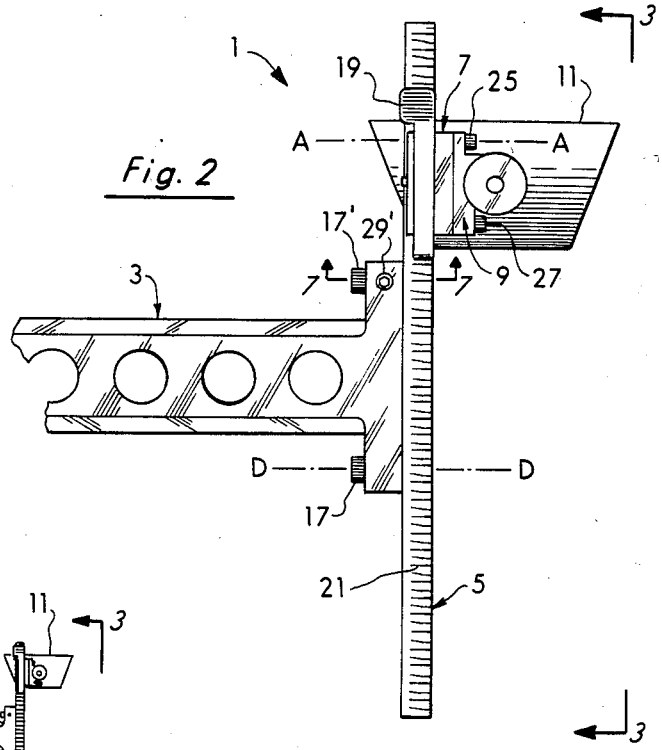
FIG. 2 is an enlarged, side view of the sight taken along line 2—2 of FIG. 3.
Figure 3:
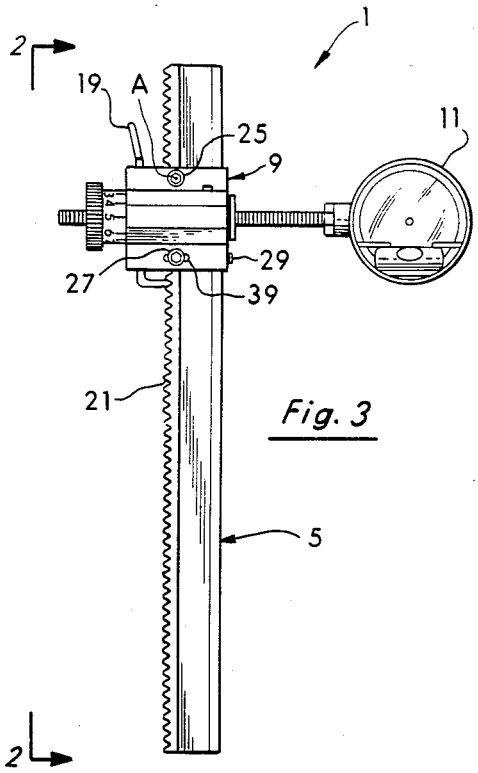
FIG. 3 is a front view of the sight taken along lines 3—3 of FIGS. 1 and 2.

As best seen in FIGS. 1-3, the sight 1 of the preferred embodiment of the present invention includes an extension bar 3, sight bar 5, carriage 7 (see FIG. 2), sight-supporting block 9, and bubble sight 11. In a known and conventional manner, the extension bar 3 is secured at 13 (see FIG. 1) to the archery bow 15 and the sight bar 5 is secured by screws 17 and 17' (see FIG. 2) to the extension bar 3. Further, in a known and conventional manner, the carriage 7 is selectively positionable along the sight bar 5 by disengaging the spring-biased, latch member 19 from engagement with the notches 21 of the sight bar 5, sliding the carriage 7 up or down along the sight bar 5, and then re-engaging the latch member 19 with the notches 21. Additionally, in a known and conventional manner, the sight-support block 9 is mounted for pivotal movement about the axis A—A of screw 25 (see FIGS. 2 and 3) relative to the underlying carriage 7. In this manner, the bubble sight 11 which is mounted on the sight-supporting block 9 can be leveled when the bow 15 is supported in a vertical plane. Such general structure to this point is known and conventional as illustrated by U.S. Pat. No. 3,854 217 to Killian. With this structure as disclosed by Killian in his FIG. 3, adjustments of his sight-supporting block 50 relative to his carriage 48 to level his bubble sight 112 can be accomplished by unloosening his screws 56, manually moving his sight-supporting block 50 about the axis of the upper screw 56, and then retightening the screws 56. During such operation, Killian's elongated slot 58 accommodates the relative movement of the lower screw 56 which like his upper screw 56 is mounted to his underlying carriage 48. As discussed above, this procedure is fairly imprecise and cumbersome. Further, fine adjustments of his sight-supporting block 50 relative to the underlying carriage 48 are somewhat difficult to do with just this structure because it is necessary to both manually move and hold the sight-supporting block 50 in position while retightening the screws 56. Also, if the desired alignment is not initially obtained, the entire process must be repeated from the beginning and it becomes more a matter of chance than precision that the correct alignment is ultimately achieved.

Figure 4:
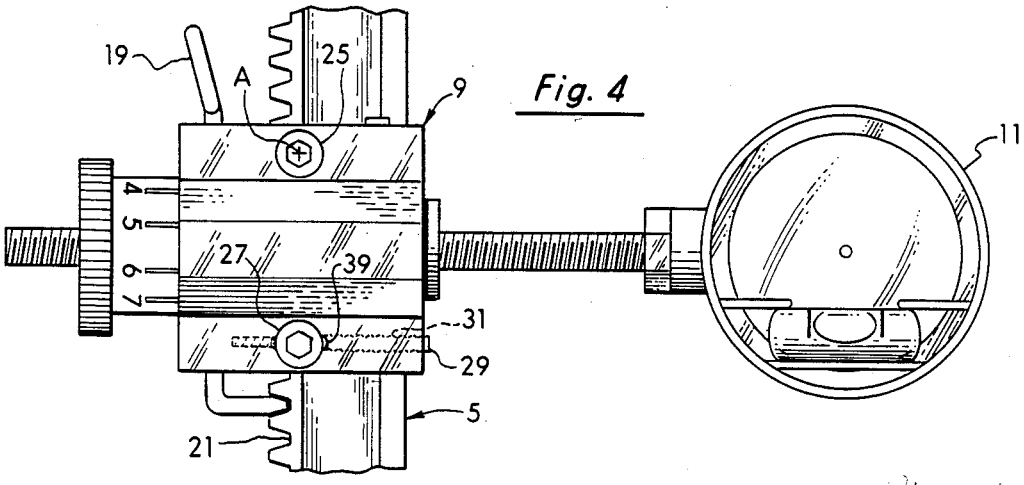
FIG. 4 is a front view of portions of the sight.

In this light, the preferred embodiment of the present invention as best seen in FIG. 4 provides additional structure to that of Killian which enables the archer to precisely make fine and accurate adjustments of the relative positioning of the sight-supporting block 9 of the present invention on the carriage 7. Further, this precise adjustment is maintained while the locking screws 25 and 27 are retightened and unlike Killian, if the desired alignment is not initially achieved, the additional structure of the present invention will hold the members 7 and 9 in the prior setting which can then be used as a reference point to make any additional adjustments. Also, the additional structure of the present invention enables the fine and accurate adjustments of the relative positioning of the members 7 and 9 to be accomplished by operation of only a single set screw 29. More specifically and referring to FIGS. 4–6, the set screw 29 is mounted in a threaded bore 31 in the sight-supporting block 9. Set screw 29 and bore 31 (see FIG. 6) extend along axis C—C which is perpendicular to and intersects axis B—B of locking screw 27. Opposite the threaded bore 31 on the other side of screw 27 is a smooth, cylindrical bore 33 within which is mounted coil spring 35. Like set screw 29 and bore 31, spring member 35 and bore 33 extend along axis C—C; however, the diameter d of bore 33 is smaller than the diameter d' of bore 31 as the preferred method of manufacture involves first drilling a bore of diameter d and length x through member 9 from right to left in FIG. 6 and then threading the right hand portion to make bore 31 which receives the correspondingly threaded set screw 29.

Figure 5:
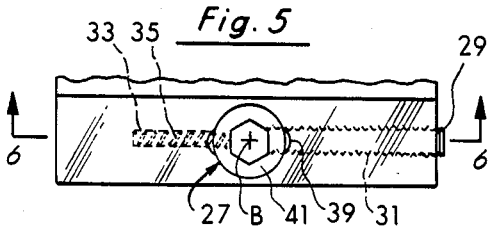
FIG. 5 is an enlarged, front view of the adjustment mechanism of the sight taken along line 5—5 of FIG. 6.
Figure 6:
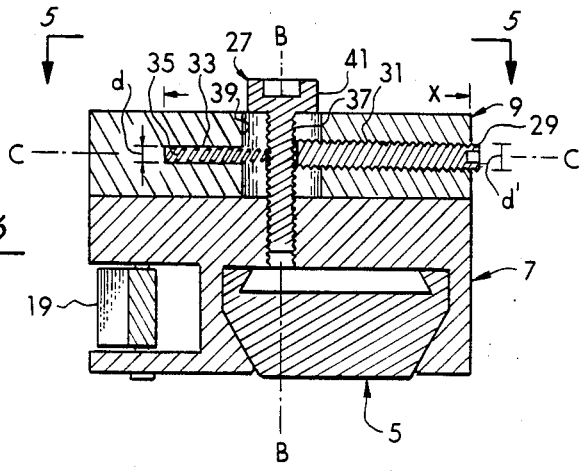
FIG. 6 is a cross-sectional view taken along line 6—6 of FIG. 5.

In operation as best seen in FIGS. 4–6, locking screws 25 and 27 are first loosened as in Killian. However, thereafter, the adjustment of the position of member 9 relative to member 7 is accomplished by manipulation of the single set screw 29 either clockwise to pivot member 9 counterclockwise about pivotal axis A—A relative to member 7 or counterclockwise to pivot member 9 clockwise about pivotal axis A—A relative to member 7. More specifically and referring to FIG. 6, the spring member 35 and set screw 29 in the preferred embodiment abut the shaft or screw member 27 on opposite sides of the shaft portion 37 thereof. The spring member 35 and set screw 29 are preferably diametrically opposite one another so that the force applied by the set screw 29 to the shaft portion 37 works directly against the force of the spring member 35 and vice versa. Consequently, as the set screw 29 is moved to the left in FIG. 6, it works against the force of the spring member 35 and moves the member 9 to the right relative to the member 7. Conversely, if the set screw 29 is moved to the right in FIG. 6, the member 9 moves relative to the member 7 in the opposite direction under the force of spring member 35. In this manner, it is only necessary to operate the single set screw 29 to precisely position the member 9 relative to the member 7. Thereafter, with members 29 and 35 holding the desired positioning, the locking screws 25 and 27 can then be retightened if desired to further ensure that the members 9 and 7 hold this desired relative positioning.

In moving the member 9 relative to the member 7, the slot 39 serves to accommodate the shaft portion 37 of the locking screw 27. The slot 39 is elongated along a first, horizontal axis in FIGS. 5 and 6 which is perpendicular to the axis B—B of screw 27 and perpendicular to the central axis of the slot 39. In FIGS. 5 and 6, the axes B—B and central axis of the slot 39 are shown in a colinear relationship. Nevertheless, regardless of where the shaft portion 37 is positioned within the slot 39, the slot 39 always extends along and about the shaft axis B—B outwardly of the shaft portion 37. Further, the slot 39 has a minimum width in a direction perpendicular to the first axis thereof (i.e., vertically in FIG. 5) and as best seen in FIG. 5, the width of the head portion 41 of the screw 27 is greater. Consequently, the head portion 41 of the locking screw 27 will engage the member 9 outwardly of the slot 39 when the screw 27 is retightened and will thereby securely press the members 7 and 9 together to further ensure the holding of the desired relative positioning. The head portion 41 is shown as extending symmetrically about the axis B—B; however, if a hexagonal or other shaped head is used, the minimum width of the head will preferably be greater than the minimum width of the slot 39 so that the head will not pass through the slot 39.

Figure 7:
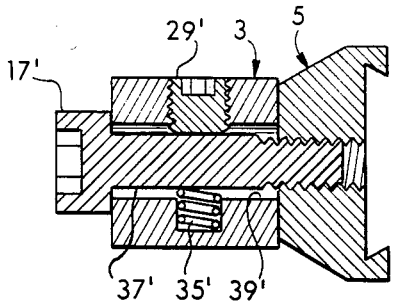
FIG. 7 is a view taken along lines 7—7 of FIG. 2 illustrating a second embodiment of the present invention.

FIG. 7 is taken along line 7—7 of FIG. 2 and illustrates a second embodiment of the present invention in which the elongated slot 39', adjustment member 29', and spring member 35' are positioned in the fixed member 3 rather than the member that is relatively pivoted as in the embodiment of FIGS. 4–6. Further, the shaft portion 37' against which the set screw 29' and spring member 35' abut has a smooth, cylindrical shape rather than the threaded one of shaft portion 37 in FIG. 6. In operation as shown in FIGS. 2 and 7, the sight bar 5 can then be pivotally moved relative to the extension bar 3 about the axis D—D of the lower locking screw 17 by manipulation of the single set screw 29' in the manner of the preferred embodiment of FIGS. 4–6. With the embodiments of FIGS. 4–6 and 7, adaptations of the present invention are shown with the working arrangement of the spring member and set screw both in the pivoted member (FIGS. 4–6) and in the fixed member (FIG. 7).

While several embodiments of the present invention have been shown and described in detail, it is to be understood that various changes and modifications can be made without departing from the scope of the invention.

We claim:

1. A bow sight for an archery bow, said archery bow sight including:

at least first and second members, means for securing said first member to said archery bow, means for mounting said second member to said first member for pivotal movement relative thereto about a pivotal axis, and, means for selectively moving said second member relative to said first member about said pivotal axis wherein one of said first and second members has a slot therein and said moving means includes a shaft member extending along an axis and means for mounting said shaft member to the other of said first and second members with said shaft axis spaced from and substantially parallel to said pivotal axis and with at least a portion of said shaft member being received in said slot in the one of said first and second members, said shaft portion extending along and about said shaft axis and said slot extending along and about said shaft axis outwardly of said shaft portion whereby said one member with the slot therein and said shaft portion can be moved relative to each other, said moving means further including an adjustment member extending along a first axis, a spring member extending along a second axis, and means for respectively mounting said adjustment member and said spring member in said one member on opposing sides of said shaft portion with the respective axes of said adjustment and spring members substantially perpendicular to and intersecting said shaft portion and with said adjustment and spring members abutting said shaft portion, and said mounting means for said adjustment member further includes means for mounting said adjustment member for movement along the axis of said adjustment member relative to said one member whereby movement of said adjustment member along the axis thereof in one direction will cause the second member to move relative to the first member in a first direction about said pivotal axis against the force of said spring member and movement of said adjustment member in a direction opposite to said one direction will cause the second member to move about the pivotal axis relative to the first member in a direction opposite to said first direction under the force of said spring member.

2. The archery bow sight of claim 1 wherein the axes of said adjustment and spring members are substantially colinear.

3. The archery bow sight of claim 1 wherein said adjustment member is a threaded screw and said means for mounting said adjustment member for movement along the axis thereof relative to said one member is a threaded bore in said one member wherein said threaded screw can be selectively rotated clockwise and counterclockwise about the axis thereof to selectively move said threaded screw in said one direction and said direction opposite thereto.

4. The archery bow sight of claim 1 wherein said spring member is a coil spring.

5. The archery bow sight of claim 1 wherein the means for respectively mounting said adjustment member and said spring member in said one member are respective bores in said one member.

6. The archery bow sight of claim 5 wherein said bores are spaced from one another on opposite sides of said shaft portion and extend along a common axis.

7. The archery bow sight of claim 6 wherein said common axis is perpendicular to said shaft axis.

8. The archery bow sight of claim 5 wherein said bores are substantially cylindrical and extend along respective axes and the diameter of the bore for said spring member is smaller than the diameter of the bore for the adjustment member.

9. The archery bow sight of claim 1 wherein said one of said first and second members is said first member.

10. The archery bow sight of claim 9 wherein said first member is an extension bar and said second member is a sight bar.

11. The archery bow sight of claim 1 wherein said one of said first and second members is said second member.

12. The archery bow sight of claim 11 wherein said first member is a carriage and said second member is a sight-supporting block.

13. The archery bow sight of claim 1 wherein said slot extends about a central axis and is elongated along a first axis perpendicular to said central axis.

14. The archery bow sight of claim 13 wherein the means for respectively mounting said adjustment member and said spring member in said one member are respective bores in said one member, said bores being spaced from one another on opposite sides of said shaft portion and extending along a common axis parallel to the first axis of said slot.

15. The archery bow of claim 13 wherein said slot has a minimum width in a direction perpendicular to said first axis and said shaft member has a head portion extending symmetrically about and outwardly of said shaft axis, said head portion having a minimum width in a direction perpendicular to said shaft axis, said minimum width of said head portion being greater than said minimum width of said slot wherein said head portion will not pass through said slot.

16. The archery bow sight of claim 1 wherein said slot extends about a central axis at at least a minimum first distance and said shaft member has a head portion extending symmetrically about and outwardly of said shaft axis for a distance greater than said first distance whereby said head portion will not pass through said slot.

17. The archery bow sight of claim 1 wherein said shaft portion is cylindrical.

18. The archery bow sight of claim 1 further including means for selectively locking said first and second members in a desired position relative to each other whereby said second member can be pivoted relative to said first member about said pivotal axis by movement of said adjustment member and then locked in place by said locking means.

* * * * *